US010830460B2

(12) United States Patent
Salunkhe et al.

(10) Patent No.: US 10,830,460 B2
(45) Date of Patent: Nov. 10, 2020

(54) HVAC ACCESS PANEL LATCH SYSTEMS AND METHODS

(71) Applicant: Johnson Controls Technology Company, Auburn Hills, MI (US)

(72) Inventors: Ravindra B. Salunkhe, Satara (IN); Siddappa R. Bidari, Pune (IN); Praveen Y R, Davanagere (IN); Kunal J. Gandevia, Pune (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 195 days.

(21) Appl. No.: 16/116,757

(22) Filed: Aug. 29, 2018

(65) Prior Publication Data

US 2020/0063989 A1 Feb. 27, 2020

Related U.S. Application Data

(60) Provisional application No. 62/720,834, filed on Aug. 21, 2018.

(51) Int. Cl.

| | |
|---|---|
| ***E06B 3/00*** | (2006.01) |
| ***F24F 1/58*** | (2011.01) |
| ***F24F 13/20*** | (2006.01) |
| ***E05B 63/12*** | (2006.01) |
| ***E05B 17/00*** | (2006.01) |
| ***E05C 3/04*** | (2006.01) |

(52) U.S. Cl.

CPC ..... *F24F 1/58* (2013.01); *E05B 17/0025* (2013.01); *E05B 63/12* (2013.01); *E05C 3/041* (2013.01); *F24F 13/20* (2013.01)

(58) Field of Classification Search

CPC ..... E05C 3/041; E05C 19/003; E05C 19/184; E05B 63/12; E05B 17/0025; E05B 1/0007; E05B 65/006; F24F 1/58; F24F 13/20; B61D 27/00; F16B 37/067; H05K 7/20; H05K 7/20009; Y10T 292/444; Y10T 292/319; Y10T 292/37; Y10T 292/327

USPC ..... 49/504, 503, 501; 200/283, 254, 299; 292/302, 290

See application file for complete search history.

(56) References Cited

U.S. PATENT DOCUMENTS 1,411,129 A * 3/1922 Strosnider ..... A01K 1/0017 292/196
3,172,984 A * 3/1965 Cellerini ..... H01H 9/102 200/337
4,074,484 A * 2/1978 Queren ..... E05B 15/0205 292/346

(Continued)

FOREIGN PATENT DOCUMENTS

EP 1337137 A 8/2003

*Primary Examiner* — Chi Q Nguyen
(74) *Attorney, Agent, or Firm* — Fletcher Yoder, P.C.

(57) ABSTRACT

In an embodiment of the present disclosure, a latch assembly for an access panel of a housing includes a latch structure having a first surface, a second surface, and an intermediate step therebetween. The latch assembly also includes a fastener configured to facilitate coupling of the first surface to the access panel, and a locking system configured to engage with a structural support of the housing via the second surface. The locking system is configured to be rotated to secure the second surface to the structural support and rotated to release the second surface from the structural support.

23 Claims, 7 Drawing Sheets

(56) References Cited

U.S. PATENT DOCUMENTS 5,026,102 A * 6/1991 Pitman ..... E05C 19/005 292/259 R
5,556,143 A * 9/1996 Robinson ..... E05C 19/003 292/259 R
5,609,245 A * 3/1997 Cassity ..... H01H 3/04 200/254
5,737,195 A * 4/1998 Cassity ..... H01H 3/04 200/293
5,976,007 A * 11/1999 Powell ..... F24F 13/02 454/271
6,443,322 B1 9/2002 Braun et al.
6,644,903 B1 11/2003 Arand
6,657,868 B1 12/2003 Hsue
6,923,412 B2 8/2005 Wooten et al.
7,179,037 B2 2/2007 Aukzemas et al.
7,938,607 B2 5/2011 Wang
8,197,168 B2 6/2012 Liu
8,202,031 B2 6/2012 Hartmann
8,246,281 B2 8/2012 Gulistan
8,267,630 B2 9/2012 Moon et al.
8,702,184 B2 * 4/2014 Lakoduk ..... H02B 1/46 312/222
9,033,632 B2 5/2015 Komsitsky et al.
9,079,300 B2 7/2015 Poindexter et al.
9,184,573 B1 * 11/2015 Jonas ..... E05B 65/0089
9,328,753 B2 5/2016 Bachman et al.
9,482,322 B2 11/2016 Weikert et al.
2005/0129461 A1 6/2005 Bruno
2007/0258786 A1 11/2007 Orszagh et al.
2011/0188969 A1 8/2011 Michalic et al.
2014/0096363 A1 4/2014 Khamithar et al.
2014/0117681 A1 * 5/2014 Jenkins ..... E05C 19/184 292/256.71
2015/0292546 A1 10/2015 Derr et al.
2017/0051759 A1 2/2017 Zauhar et al.
2017/0363319 A1 12/2017 Long et al.
2020/0063472 A1 * 2/2020 Casternovia ..... E05C 17/166
2020/0130487 A1 * 4/2020 Dylewski, II ..... B60J 7/141

* cited by examiner

HVAC ACCESS PANEL LATCH SYSTEMS AND METHODS

CROSS REFERENCE TO RELATED APPLICATIONS

This application claims priority from and benefit of U.S. Provisional Application Ser. No. 62/720,834, filed Aug. 21, 2018, entitled "HVAC ACCESS PANEL LATCH SYSTEMS AND METHODS," which is hereby incorporated by reference in its entirety for all purposes.

BACKGROUND

The present disclosure relates generally to heating, ventilating, and air conditioning (HVAC) systems and, more particularly, to systems and methods for an access panel latch for an HVAC unit.

A wide range of applications exist for HVAC systems. For example, residential, light commercial, commercial, and industrial systems are used to control temperatures and air quality in indoor environments and buildings. Generally, HVAC units may include access panels, such as doors, that are utilized to access internal components housed or enclosed within the HVAC unit. The access panels generally include latches that are utilized to secure the access panel in a closed position on the HVAC unit to block access to the interior of the HVAC unit. While in the closed position, the access panels may also provide a seal between the interior of the HVAC unit and the external environment. Further, the exterior surface of the HVAC unit may be coated with paint, or other material, for aesthetic purposes and to provide a barrier between the HVAC unit and external conditions.

SUMMARY

In one embodiment of the present disclosure, a latch assembly for an access panel of a housing includes a latch structure having a first surface, a second surface, and an intermediate step therebetween. The latch assembly also includes a fastener configured to facilitate coupling of the first surface to the access panel, and a locking system configured to engage with a structural support of the housing via the second surface. The locking system is configured to be rotated to secure the second surface to the structural support and rotated to release the second surface from the structural support.

In another embodiment of the present disclosure, a climate management system housing includes an access panel configured to enable access to an interior of the climate management system housing, a gasket coupled to the climate management system housing and configured to provide a sealing engagement with the access panel, and a latch assembly. The latch assembly includes a latch plate having a stepped configuration, a threaded rod coupled to the latch plate, and a locking nut disposed on the threaded rod. The latch assembly is coupled to the access panel and is configured to provide a force on the gasket via the access panel, in a locked configuration of the latch assembly that includes the threaded rod coupling the latch assembly to a structural support of the climate management system housing, to provide the sealing engagement. A position of the locking nut along the threaded rod is adjustable to adjust the force.

In a further embodiment of the present disclosure, a locking assembly for a housing includes a latch plate having a first flange configured to be coupled to a door of the housing, and having a second flange with an aperture extending therethrough. The locking assembly further includes a bolt extending through the aperture in the second flange of the latch plate, a locking nut coupled to the bolt and configured to retain the bolt within the aperture of the second flange of the latch plate, and a receiving nut configured to be disposed within a frame of the housing. The locking nut is configured to abut the receiving nut when the locking assembly is in a locked configuration, and the locking assembly is configured to apply a pressure to a gasket of the housing in the locked configuration to create a sealing interface about the door.

Other features and advantages of the present application will be apparent from the following, more detailed description of the embodiments, taken in conjunction with the accompanying drawings, which illustrate, by way of example, the principles of the application.

DETAILED DESCRIPTION

Certain HVAC units may include latches configured to hold or secure an access panel, which enables access to an interior of the HVAC units, in a closed position. However, such access panel latches may be expensive to manufacture, may call for one or more tools to operate, and may scratch paint or other coating material off of an exterior of the HVAC unit. Further, such HVAC units may utilize a supplemental assembly, in addition to the latch, to serve as a handle for transitioning the access panel between closed and open positions. Accordingly, the present disclosure is directed to an improved access panel latch for a heating, ventilation, and air condition (HVAC) unit, such as a rooftop unit. The access panel latch may have an S-shaped, or stepped, configuration that enables control of pressure applied to a gasket of the HVAC unit to provide an air-tight seal about the access panel secured by the latch. Additionally, the access panel latch may include a knob or other handle configured to be hand-rotated or otherwise actuated to engage with a corresponding receiving fastener fixed to the HVAC unit to increase a pressure of the access panel onto the gasket. The engagement between the access panel latch and the receiving fastener also reduces contact between the access panel latch and painted, coated, or treated surfaces of the HVAC unit, thereby reducing scratching of the surfaces on the HVAC unit.

Figure 1:
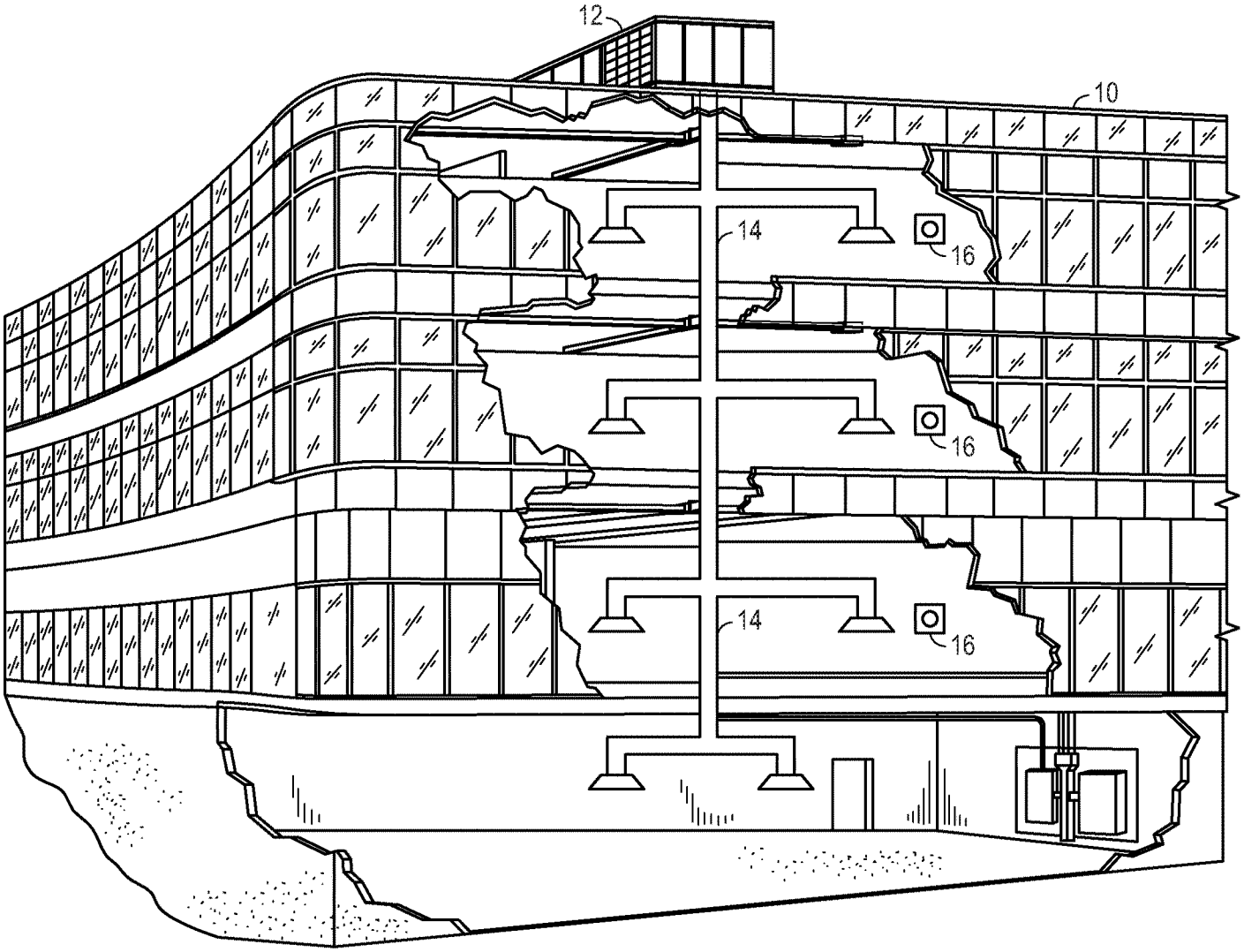
FIG. 1 is a perspective view of an embodiment of a heating, ventilation, and air conditioning (HVAC) system for building environmental management that may employ one or more HVAC units, in accordance with aspects of the present disclosure.

Turning now to the drawings, FIG. 1 illustrates a heating, ventilation, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply air stream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
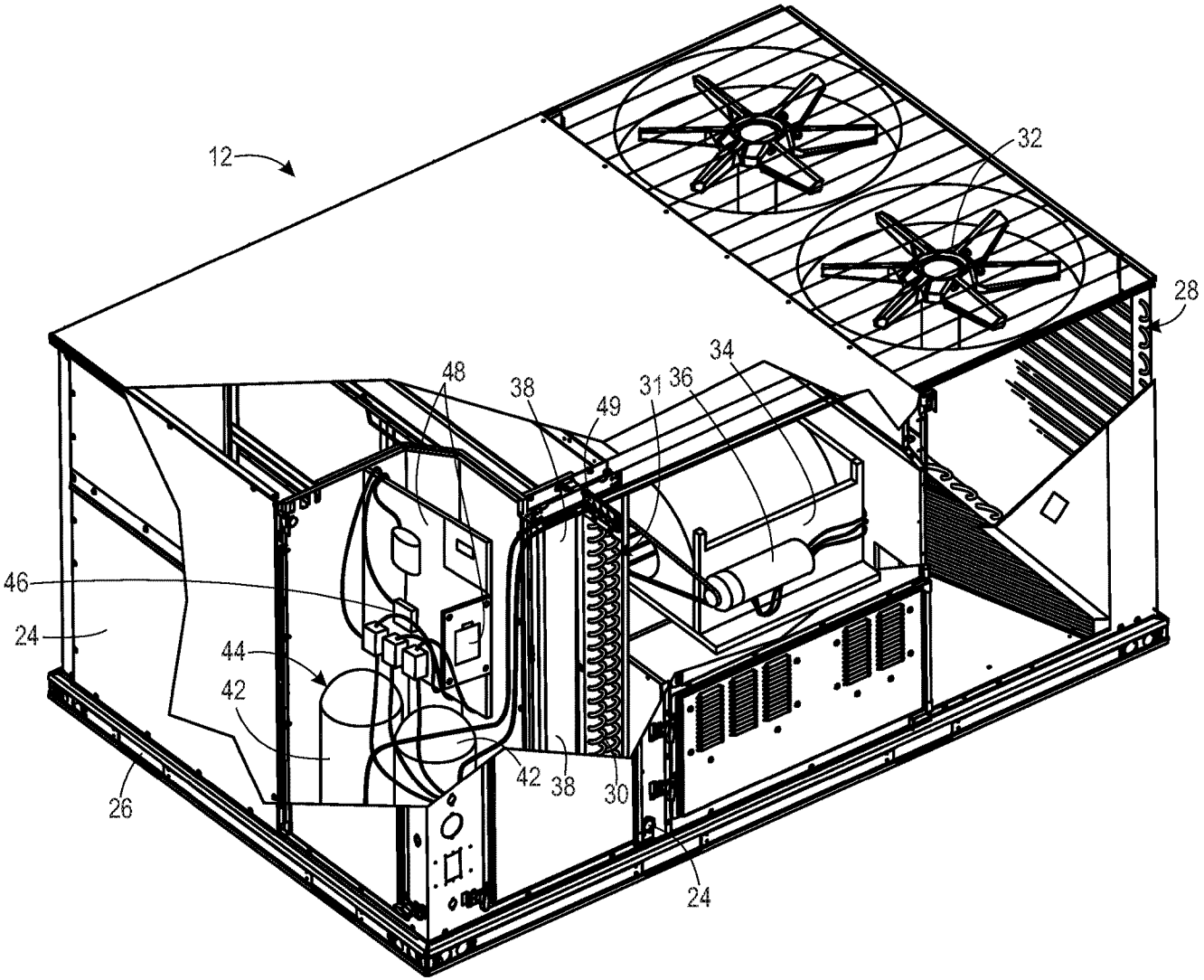
FIG. 2 is a perspective view of an embodiment of an HVAC unit, in accordance with aspects of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant (for example, R-410A, steam, or water) through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the airflows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned airflows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms (one or more being referred to herein separately or collectively as the control device 16). The control circuitry may be configured to control operation of the equipment, provide alarms, and monitor safety switches. Wiring 49 may connect the control board 48 and the terminal block 46 to the equipment of the HVAC unit 12.

Figure 3:
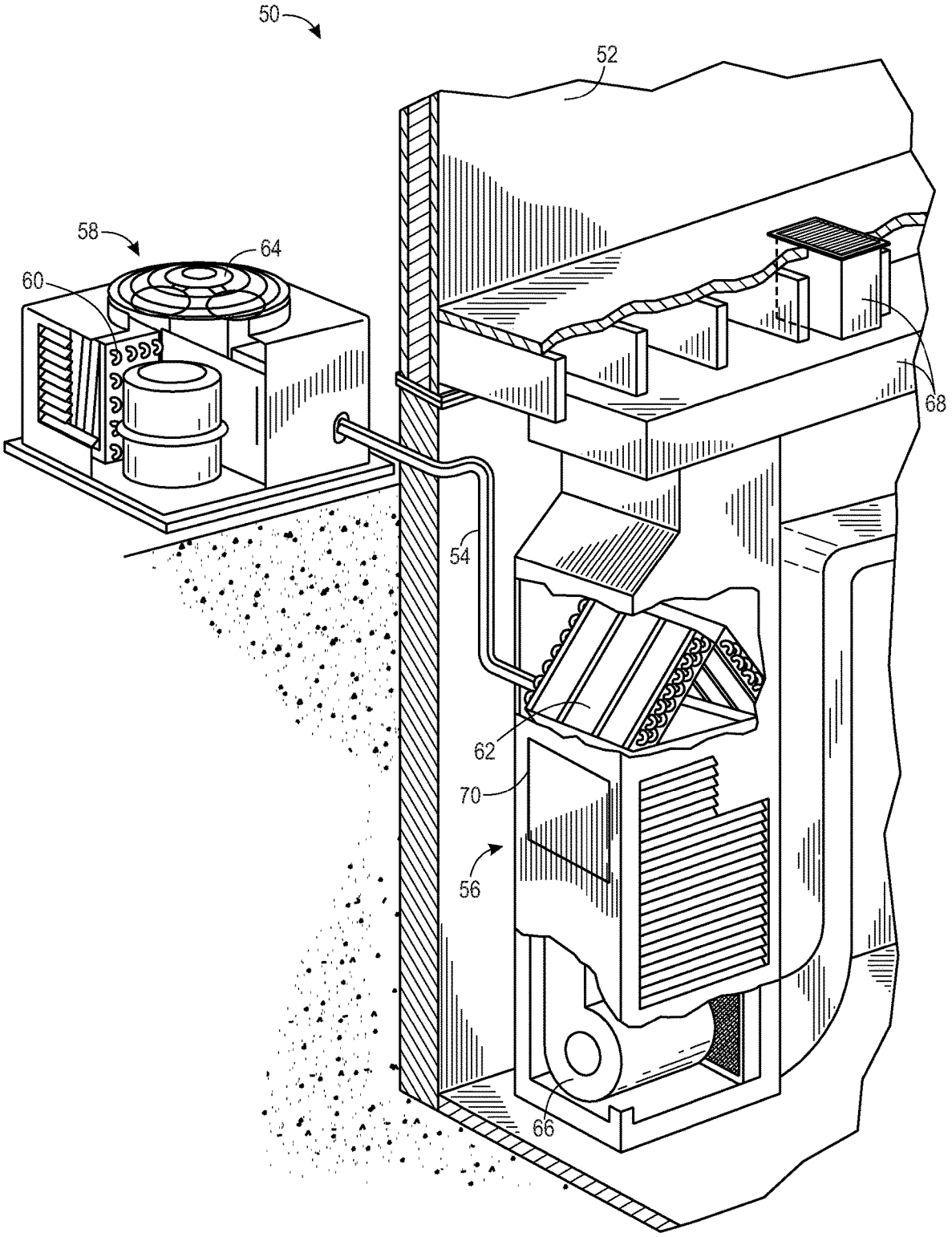
FIG. 3 is a perspective view of an embodiment of a residential split heating and cooling system, in accordance with aspects of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant (which may be expanded by an expansion device, not shown) and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat (plus a small amount), the residential heating and cooling system 50 may become operative to refrigerate additional air for circulation through the residence 52. When the temperature reaches the set point (minus a small amount), the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger (that is, separate from heat exchanger 62), such that air directed by the blower 66 passes over the tubes or pipes and extracts heat from the combustion products. The heated air may then be routed from the furnace system 70 to the ductwork 68 for heating the residence 52.

Figure 4:
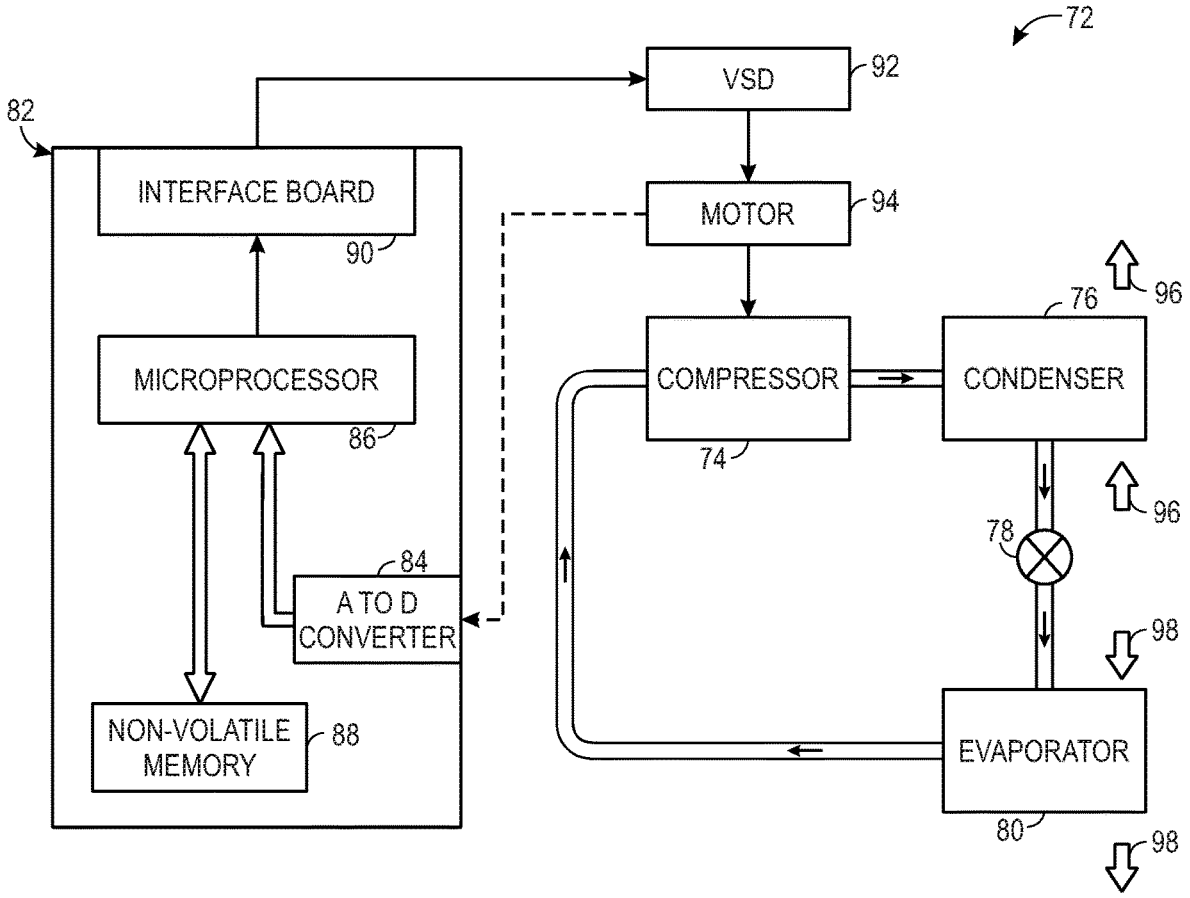
FIG. 4 is a schematic view of an embodiment of a vapor compression system that may be used in an HVAC system, in accordance with aspects of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed below, an HVAC system 100, or climate management system, such as the HVAC unit 12, the residential heating and cooling system 50, and/or the vapor compression system 72 may include a latch assembly 102 configured to secure an access panel, such as a door, of the HVAC system 100 in a closed position. The latch assembly 102 may be configured to secure the access panel of the HVAC system 100 in a closed position to restrict access to an interior of the HVAC system 100 and to provide a seal about the access panel by applying sufficient pressure to a gasket, or seal, disposed about a perimeter of the access panel and/or the access panel frame. Particularly, to apply pressure to the gasket, a handle of the latch assembly may be rotated or otherwise actuated to engage with a receiving fastener disposed within a frame of the HVAC system 100.

Figure 5:
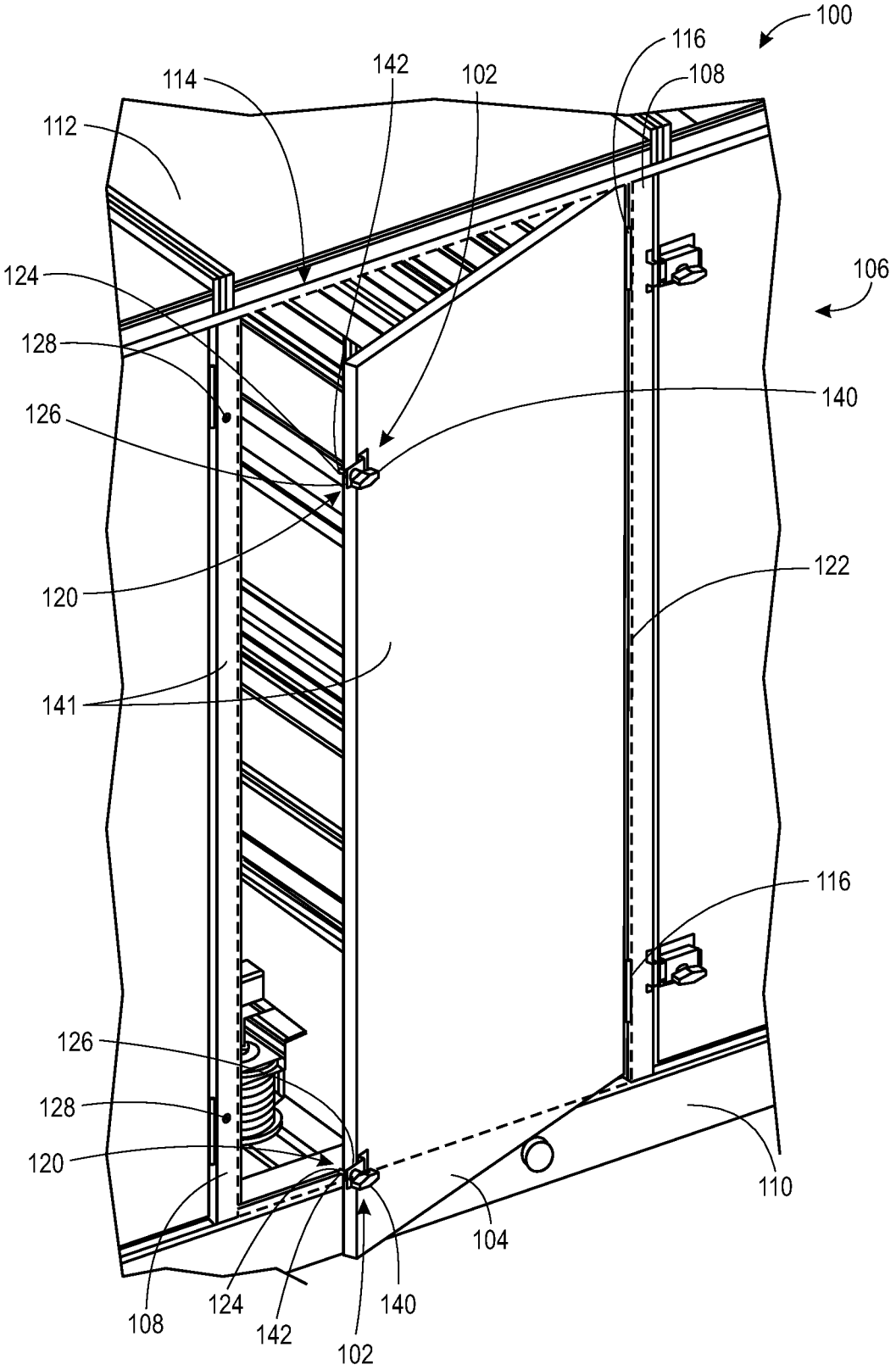
FIG. 5 is a perspective view of an embodiment of a portion of an HVAC unit, in accordance with aspects of the present disclosure.

Keeping this in mind, FIG. 5 is a partial perspective view of an embodiment of the HVAC system 100, which includes the latch assembly 102 configured to secure a closed position of a door 104, such as an access door, of the HVAC system 100 and to provide a seal about the door 104 when the door 104 is in a closed position. As similarly discussed above, the HVAC system 100 encloses various components, such as heating, cooling, and/or ventilation equipment and protects the components from the surrounding environment. The HVAC system 100 includes the door 104 to enable access to the interior of the HVAC system 100, and thus the components therein, for maintenance, cleaning, programming, replacement, or other suitable purpose. However, it is occasionally desirable to block access to the interior of the HVAC system 100. To this end, the door 104 includes the latch assembly 102 to secure the door 104 in a closed position, thereby blocking access into the HVAC system 100. While the illustrated embodiment is described as utilizing the latch assembly 102 with the door 104, it should be appreciated that the latch assembly 102 may be used with other types of access panels of the HVAC system 100 to secure a closed position of the access panel. Indeed, multiple latch assemblies 102 may be used for a single access panel or for multiple access panels of the HVAC system 100.

As shown, the HVAC system 100 includes a housing 106 having the door 104, uprights 108, such as structural support members of the housing 106, a base 110, and a top 112. While in the closed position, the door 104 is positioned within a doorframe 114 of the housing 106 that is defined is by the uprights 108, the base 110, and the top 112. Particularly, the door 104 may be rotated about a hinge 116 to be substantially flush between the uprights 108 of the housing 106 when in the closed position. The door 104 may also be rotated about the hinge 116 to an open position to provide access to an interior of the housing 106 through the doorframe 114.

While in the closed position, a rotatable locking assembly 120, or rotatable locking system, of the latch assembly 102 is configured to lock the door 104 against the housing 106 to provide an air-tight seal about a perimeter of the door 104. Particularly, while in a locked configuration, the rotatable locking assembly 120 causes the door 104 to apply pressure to a gasket 122 disposed about the doorframe 114 to provide the sealing interface. For example, the rotatable locking assembly 120 includes a bolt 124 extending through a latch plate 126, or latch structure, that is rigidly coupled to the door 104. The bolt 124 is configured to be torqued, or rotated, to engage with a receiving fastener 128, such as a nut, disposed within one of the uprights 108 of the housing 106. As the bolt 124 engages with the receiving fastener 128, the rotatable locking assembly 120 causes the door 104 to press against the gasket 122 to provide the seal. In some embodiments, the bolt 124 may be configured to engage with a structural support of the housing 106 other than the upright 108, such as a wall panel, via a fastener, such as the receiving fastener 128.

To further illustrate, the bolt 124 of the rotatable locking assembly 120 includes a knob 140, or handle, and a threaded shaft 142 extending from the knob 140. In certain embodiments, the knob 140 may be specifically designed/shaped to be easily gripped and torqued by a human hand. That is, the knob 140 may be gripped by an operator to transition the door 104 between the closed position and the open position. In some embodiments, the knob 140 may include a thumb screw head. Further, when the door 104 is in the closed position, the knob 140 may then be torqued or rotated to engage the threaded shaft 142 with the receiving fastener 128. As the knob 140 is torqued, the threaded shaft 142 that extends from the knob 140 may engage with the receiving fastener 128 and cause the latch assembly 102 to apply the force to the gasket 122 via the door 104. In this manner, the gasket 122 may be compressed between the door 104 and the doorframe 114 to provide the seal about the perimeter of the door 104.

As shown, the door 104 may include two latch assemblies 102. However, it is to be understood that the door 104 may include any suitable number of latch assemblies 102. For example, in certain embodiments, the door 104 may include one latch assembly 102, three latch assemblies 102, or more than three latch assemblies 102. Moreover, as discussed in further detail below, an outer surface of the housing 106 and/or latch assembly 102 may include a surface protectant 141, such as a layer of paint, protective coating, or other coating material. The latch assembly 102 may be designed to reduce or prevent wear of the surface protectant 141 while the latch assembly 102 is actuated to transition the door 104 between the open and closed positions. Also, as discussed in further detail below, the latch assembly 102 may be designed to reduce or prevent wear or degradation of the surface protectant 141 while the latch assembly 102 is actuated to lock the door 104 and provide the seal.

Figure 6:
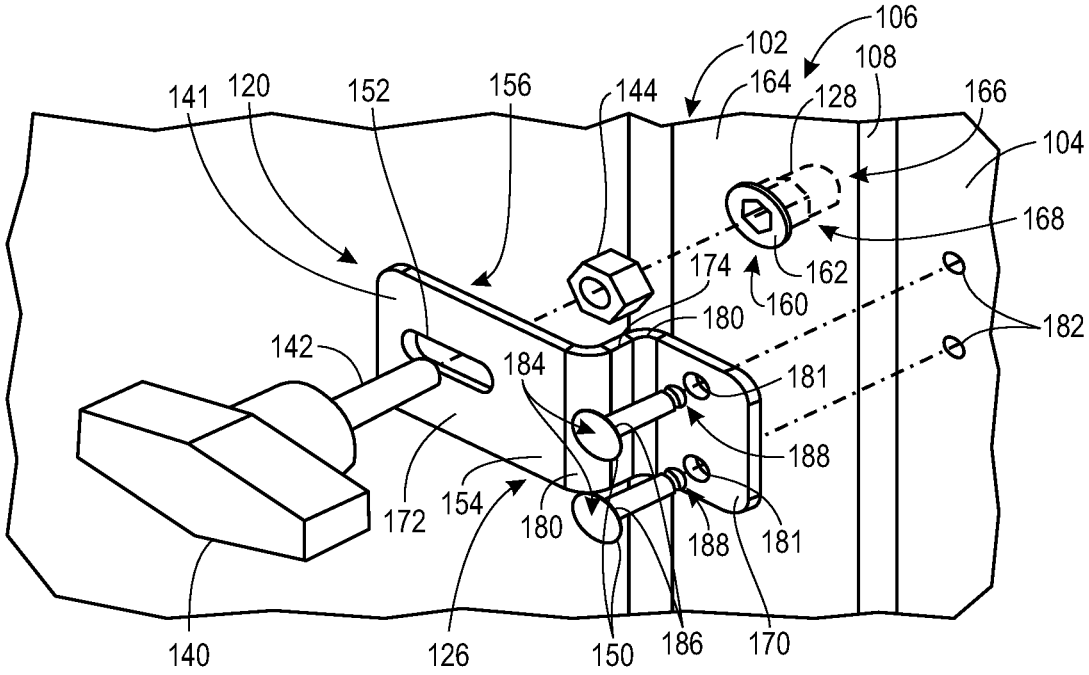
FIG. 6 is an exploded perspective view of an embodiment of an access panel latch that may be used to secure an access panel of an HVAC unit, in accordance with aspects of the present disclosure.

Keeping this in mind, FIG. 6 is a perspective view of the latch assembly 102 in an exploded view. As shown, the latch assembly 102 includes the rotatable locking assembly 120 having the knob 140, the threaded shaft 142 extending from the knob 140, and a locking nut 144 configured to be coupled to the threaded shaft 142. The latch assembly 102 further includes the receiving fastener 128, such as a nut, coupled to the upright 108, the latch plate 126, and one or more fasteners 150, such as rivets, configured to couple the latch plate 126 to the door 104.

As shown, the threaded shaft 142 of the bolt 124 is configured to extend through a latch aperture 152 of the latch plate 126 and couple to the locking nut 144. That is, the bolt 124 is coupled to the latch plate 126, such that the knob 140 is disposed adjacent to an exterior side 154 of the latch plate 126, and the locking nut 144 is disposed adjacent to an interior side 156, or engagement face, of the latch plate 126. As discussed below, the interior side 156, or engagement face, of the latch plate 126 is configured to engage with the door 104, the upright 108, a panel of the housing 106, or other member of the housing 106. As the locking nut 144 is torqued further onto the threaded shaft 142 toward the latch plate 126, the locking nut 144 may abut the interior side 156 of the latch plate 126. As the locking nut 144 abuts the latch plate 126, the locking nut 144 applies a force against the interior side 156 of the latch plate 126, thereby causing the knob 140 to apply a substantially equal force to the exterior side 154 of the latch plate 126. In this manner, the locking nut 144 and the knob 140 may cause the latch plate 126 to experience a compressive force to prevent, block, or inhibit the bolt 124 from sliding within the latch aperture 152. Indeed, as shown, the latch aperture 152 may include elongated geometry, such as an extended slot, to allow lateral adjustment of the bolt 124 within the latch aperture 152. Accordingly, the locking nut 144 may be loosened to enable lateral adjustment of the bolt 124 within the latch aperture 152 and may be tightened to block the bolt 124 from lateral adjustment within the latch aperture 152. However, while the compressive force on the latch plate 126 caused by the knob 140 and the locking nut 144 is sufficiently high so as to block lateral movement of the bolt 124 within the latch aperture 152, the compressive force is simultaneously sufficiently low so as to enable rotation of the bolt 124 within the latch aperture 152 at a substantially fixed lateral position within the latch aperture 152. In this way, the knob 140 may be positioned within the latch aperture 152 to reliably align with the receiving fastener 128. The locking nut 144 may then be tightened to block or prevent the knob 140 from moving laterally out of alignment with the receiving fastener 128 while enabling the threaded shaft 142 to be torqued into the receiving fastener 128.

In other embodiments, the locking nut 144 may be positioned on the threaded shaft 142 such that a distance between the locking nut 144 and the knob 140 along the threaded shaft 142 is greater than a thickness of the latch plate 126. In other words, the locking nut 144 may be positioned such that the locking nut 144 and the knob 140 do not apply a compressive force to the latch plate 126. In such embodiments, the bolt 124 may easily slide within the length of the latch aperture 152 and may be continuously adjusted prior to engagement with the receiving fastener 128. As discussed below, the position of the locking nut 144 along the threaded shaft 142 relative to the knob 140 may provide an upper limit to the force applied to the gasket 122 while the latch assembly 102 is actuated into in the locked configuration. Further, in some embodiments, the latch aperture 152 may be a substantially circular aperture, which may not enable lateral movement or adjustment of the threaded shaft 142 within the latch aperture 152.

As mentioned above, the receiving fastener 128 may be a hex rivet nut, or other rivet nut, that is coupled to the upright 108 of the housing 106. Particularly, the receiving fastener 128 may be a rivet whereby a first end 160 of the receiving fastener 128 includes a lip 162, head, or flange configured to abut against an outer surface 164 of the upright 108. A second end 166 of the receiving fastener 128, opposite the first end 160, is configured to be set, or peened, to create a ridge, or head, to abut against an opposite surface (relative to the outer surface 164) of the upright 108 once the receiving fastener 128 is inserted within an aperture 168 of the upright 108. Indeed, the receiving fastener 128 and the aperture 168 may both be hexagonally shaped to prevent or block rotation of the receiving fastener 128 within the aperture 168. However, it is to be understood that the receiving fastener 128 and the aperture 168 may include any suitable, complementary, and non-circular geometries, so as to block rotation of the receiving fastener 128 within the aperture 168.

As shown, the lip 162 of the receiving fastener 128 may be disposed against the outer surface 164 of the upright 108. Accordingly, when the bolt 124 is torqued into the receiving fastener 128, the locking nut 144 may abut against the lip 162 of the receiving fastener 128. Therefore, the locking nut 144 may be blocked from contacting the outer surface 164 such that any layer of the surface protectant 141 disposed on the outer surface 164 may correspondingly be shielded from contacting the locking nut 144. Specifically, the lip 162 of the receiving fastener 128 may be disposed between the locking nut 144 and the outer surface 164 of the upright 108 when the bolt 124 is torqued into the receiving fastener 128. Further, it should be noted that while the receiving fastener 128 is discussed herein as coupled to the upright 108 of the housing 106, it is to be understood that the receiving fastener 128 may be coupled to any suitable portion of the housing 106 that is adjacent to the door 104. As discussed herein, the bolt 124, the receiving fastener 128, the aperture 168, or a combination thereof may be referred to as a coupler configured to facilitate coupling the second flange 172 to the upright 108, or other structural support of the housing 106.

Moreover, similar to the housing 106 of the HVAC system 100, the latch plate 126 may also include the surface protectant 141, such as paint. To prevent or reduce wear and degradation of the surface protectant 141 from the exterior side 154 of the latch plate 126, the knob 140 may be formed of a material with a suitably low hardness. For example, the knob 140 may be formed from a material, such as plastic. Therefore, when the knob 140 is rotated against the exterior side 154 of the latch plate 126 to implement the locked configuration of the latch assembly 102, the material of the knob 140 will not remove or scratch away the surface protectant 141 from the exterior side 154 of the latch plate 126.

The latch plate 126, or latch structure, may include a first flange 170 having a first surface interfacing and coupled to the door 104 of the HVAC system 100. The latch plate 126, or latch structure, also includes a second flange 172 having a second surface and the latch aperture 152. The latch plate 126 is configured to receive the bolt 124 via the latch aperture 152. The latch plate 126, or latch structure further includes an intermediate segment 174 coupling the first flange 170 to the second flange 172. In some embodiments, the latch plate 126, or latch structure, may be a single substantially flat plate having the latch aperture 152 at a first end. Further, in such embodiments, the latch plate 126 may be coupled to the door 104 via a spacer extending from, or coupled to, a second end, opposite from the first end.

As shown, the intermediate segment 174 may provide an offset distance between the first flange 170 and the second flange 172. For example, the latch plate 126 may include an S-shaped, or stepped, configuration defined by the first flange 170, the second flange 172, and the intermediate segment 174. As discussed in further detail below in reference to FIGS. 9 and 10, the offset and corresponding S-shaped, or stepped, configuration of the latch plate 126 may enable control of the force applied to the gasket 122 by the door 104 when the latch assembly 102 is used to close and secure the door 104 against the HVAC system 100. In certain embodiments, the first flange 170 and the second flange 172 may be substantially parallel to each other, while the intermediate segment 174 is substantially perpendicular to both the first flange 170 and the second flange 172. Further, in some embodiments, the intermediate segment 174 may connect to the first flange 170 and to the second flange 172 at obtuse or acute angles. Further still, in certain embodiments, the first flange 170 and the second flange 172 may each be coupled to the intermediate segment 174 via joints 180 that includes a chamfer, a fillet, or other transitional geometry.

As mentioned above, the first flange 170 of the latch plate 126 is configured to be coupled to the door 104 of the HVAC system 100 via the fasteners 150, such as rivets. To this end, the first flange 170 may include a set of flange apertures 181, and the door 104 may include a corresponding number of door apertures 182. The fasteners 150 are configured to extend through the flange apertures 181 and through the door apertures 182 to couple the latch plate 126 to the door 104. Indeed, similar to the receiving fastener 128, the fasteners 150 may be rivets whereby a first end 184 of each fastener 150 includes a head 186, or lip, configured to abut against the exterior side 154 of the latch plate 126, while a second end 188 of each fastener 150 is configured to be set, or peened, to create a ridge, or head, to abut against an interior surface of the door 104 once the fastener 150 is inserted within the flange apertures 181 and the door apertures 182. As shown, in certain embodiments, the latch plate 126 may be coupled to the door 104 via two fasteners 150 extending through the two corresponding flange apertures 181 and door apertures 182. However, it is to be understood that the latch plate 126 may be coupled to the door 104 with any suitable number of fasteners 150 and corresponding number of apertures 181,182. As discussed herein, the fastener 150, the flange apertures 181, the door apertures 182, or a combination thereof may be referred to as a coupler configured to facilitate coupling the first flange 170 to the door 104, or access panel.

Figure 7:
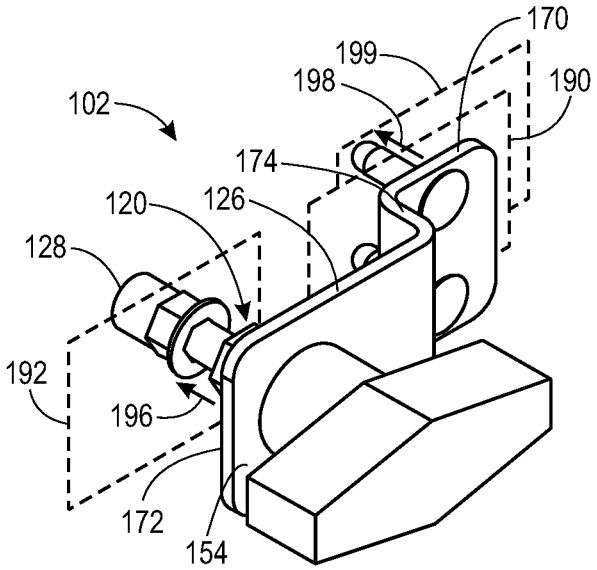
FIG. 7 is an assembled perspective view of the access panel latch of FIG. 6, in accordance with aspects of the present disclosure.

FIG. 7 is an assembled perspective view of an embodiment of the latch assembly 102. As discussed above, the first flange 170 of the latch plate 126 is rigidly and/or integrally coupled to a movable portion 190 of the housing 106, such as the door 104 or other access panel of the HVAC system 100. The latch assembly 102 further includes the rotatable locking assembly 120 configured to rotate, engage with, and couple to a stationary portion 192 of the housing 106, such as the upright 108. Generally, as the rotatable locking assembly 120 is rotated and torqued into the receiving fastener 128, the rotatable locking assembly 120 may apply a first force 196 on the exterior side 154 of the second flange 172 and toward the receiving fastener 128. Accordingly, the first force 196 imparts a bending moment on the latch plate 126 that causes the first flange 170 apply a second force 198 to the movable portion 190 in a direction that is substantially parallel to the direction of the first force 196. Indeed, because the latch plate 126 is a substantially rigid object, the first force 196 may also be substantially equal in magnitude to the second force 198. As discussed above, the second force 198 may cause the movable portion 190 to apply pressure to an object 199, such as the gasket 122, to provide a seal. Indeed, the latch assembly 102 may be applied to any suitable application having a stationary portion and a movable portion, such as automotive applications, HVAC applications, and so forth.

Figure 8:
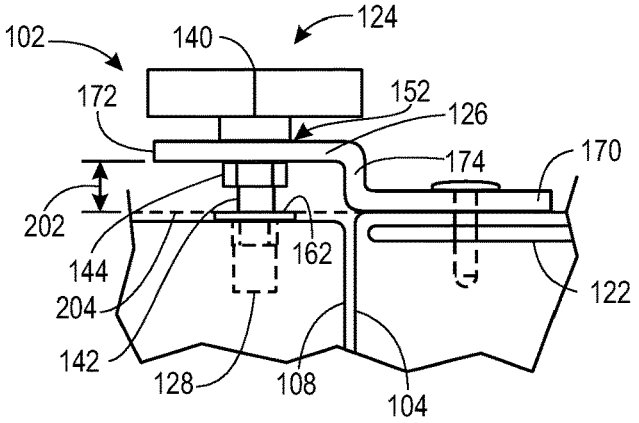
FIG. 8 is a schematic view of the access panel latch of FIG. 6, in accordance with aspects of the present disclosure.
Figure 9:
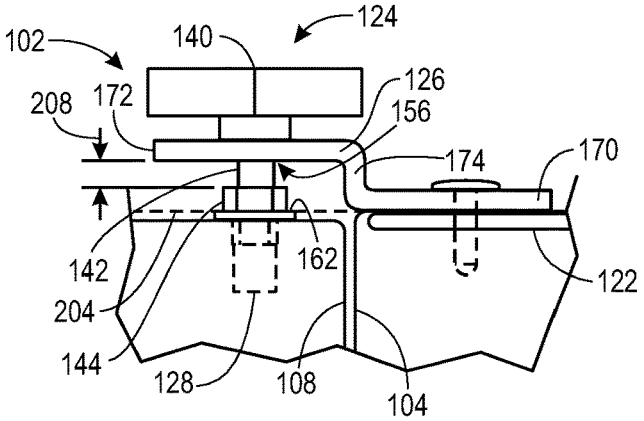
FIG. 9 is a schematic view of the access panel latch of FIG. 6, in accordance with aspects of the present disclosure.

Keeping this in mind, FIGS. 8 and 9 are side schematic views of embodiments of the latch assembly 102. As mentioned above, the S-shaped, or stepped, configuration of the first flange 170, the second flange 172, and the intermediate segment 174 may limit the force that the latch assembly 102 may apply to the gasket 122 via the door 104. To illustrate, when the bolt 124 is torqued into the receiving fastener 128, the bolt 124 may be continuously torqued until the locking nut 144 abuts the receiving fastener 128. Accordingly, as discussed in further detail below, the position of the locking nut 144 on the threaded shaft 142 may provide a limit to the force that the latch assembly 102 applies to the gasket 122.

For example, in certain embodiments, as shown in FIG. 8, the locking nut 144 may be positioned along the threaded shaft 142, such that the locking nut 144 and the knob 140 apply a compressive force to the second flange 172. In this manner, translational or lateral movement of the bolt 124 within the latch aperture 152 is blocked.

As discussed above, the bolt 124 may be torqued into the receiving fastener 128 until the locking nut 144 abuts against the receiving fastener 128. As also discussed above, the force applied to the gasket 122 via the door 104 and the latch assembly 102 increases as the bolt 124 is further torqued into the receiving fastener 128. Thus, because the position of the locking nut 144 is set against the second flange 172, the offset between the first flange 170 and the second flange 172, as set by the intermediate segment 174, limits the force that the latch assembly 102 and the door 104 are capable of applying to the gasket 122. More specifically, a length 202 of the offset, as measured by the position of the second flange 172 relative to a plane 204 defined by the first flange 170, limits the force applied to the gasket 122. As such, force that the latch plate 126 and the door 104 are capable of applying to the gasket 122 may be increased as the length 202 of the offset is increased, which is enabled by the S-configuration of the latch plate 126. In some embodiments, a size, or length, of the locking nut 144 may be changed to adjust the force that the latch plate 126 and the door 104 are capable of applying to the gasket 122. For example, an increase in size/length of the locking nut 144 may result in a decrease of the force that the latch plate 126 and door 104 are capable of applying to gasket 122. The decrease in force is due to the increased size/length of the locking nut 144 decreasing a distance that the threaded shaft 142 may be inserted into the receiving fastener 128.

Moreover, in certain embodiments, as shown in FIG. 9, the locking nut 144 may be positioned along the threaded shaft 142 such that a distance 208 between the locking nut 144 and the knob 140 is greater than a thickness of the second flange 172. In this manner, the bolt 124 may easily be laterally adjusted within the latch aperture 152. That is, the bolt 124 may be translated within the elongated slot geometry of the latch aperture 152.

As shown, the bolt 124 may be torqued into the receiving fastener 128 until the locking nut 144 abuts against the receiving fastener 128. As discussed above, the force applied to the gasket 122 via the latch assembly 102 and the door 104 increases as the bolt 124 is further torqued into the receiving fastener 128. Further, the offset between the first flange 170 and the second flange 172 provided by the intermediate segment 174 enables the locking nut 144 to be positioned along the threaded shaft 142 between the second flange 172 and the plane 204 defined by the first flange 170. Thus, the offset between the first flange 170 and the second flange 172 may limit the range of motion of the locking nut 144, thereby limiting the force that the latch assembly 102 and the door 104 are capable of applying to the gasket 122 when the door 104 is secured in the closed position. More specifically, the distance 208 between the locking nut 144 and the knob 140 limits the force applied to the gasket 122. For example, as the distance 208 between the locking nut 144 and the knob 140 increases, the maximum allowable limit on the force applied to the gasket 122 correspondingly decreases. The converse also holds true. Accordingly, the position of the locking nut 144 on the threaded shaft 142 within the range provided by the offset of the intermediate segment 174 limits the force applied to the gasket 122, which is enabled by the S-configuration of the latch plate 126.

Figure 10:
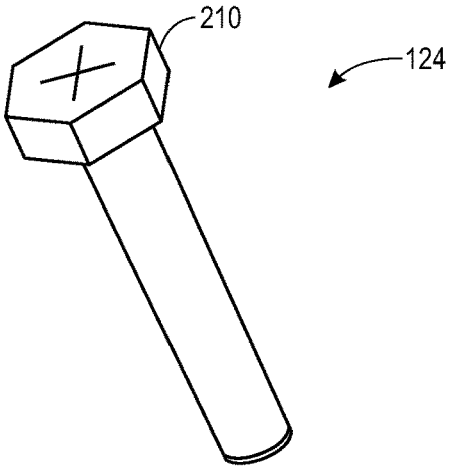
FIG. 10 is a perspective view of an embodiment of a bolt of the access panel latch of FIG. 6, in accordance with aspects of the present disclosure.

Further, as shown in FIG. 10, in some embodiments, the bolt 124 may include a bolt head 210 that is configured to be actuated by a tool, such as a screw driver or wrench. That is, as opposed to the knob 140 or thumb nut, which are configured to be directly torqued by a human hand, the bolt 124 may include the bolt head 210, which is configured to be directly torqued by a tool.

Accordingly, the present disclosure is directed to a latch assembly for an HVAC unit, such as a rooftop unit. The latch assembly may be coupled to an access panel, such as a door, of the HVAC unit and includes a handle to transition the access panel between open and closed positions. Moreover, while in the closed position, a rotatable locking assembly of the latch assembly is configured to be rotated, such as by the handle, to lock the access panel in the closed position and apply pressure to a gasket between the access panel and the HVAC unit to provide an air-tight seal about the access panel. The latch assembly is further configured to prevent or reduce wear of any surface protectant disposed on an exterior surface of the HVAC unit. Moreover, the parts of the latch assembly may be cost efficient and easily assembled.

While only certain features and embodiments of the present disclosure have been illustrated and described, many modifications and changes may occur to those skilled in the art, such as variations in sizes, dimensions, structures, shapes and proportions of the various elements, values of parameters, mounting arrangements, use of materials, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the embodiments, all features of an actual implementation may not have been described, such as those unrelated to the presently contemplated best mode of carrying out the disclosure, or those unrelated to enabling the claimed features. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A latch assembly for an access panel of a housing, comprising:
   - a latch structure having a first surface, a second surface, and an intermediate step therebetween;
   - a fastener configured to facilitate coupling of the first surface to the access panel; and
   - a locking system configured to engage with a structural support of the housing via the second surface, wherein the locking system comprises a threaded rod, a knob coupled to the threaded rod, and a locking nut coupled to the threaded rod, and wherein the locking system is configured to be rotated to secure the second surface to the structural support and rotated to release the second surface from the structural support.

2. The latch assembly of claim 1, comprising a seal arranged to engage the access panel and the structural support to facilitate sealing a climate management system within the housing when the locking system secures the second surface to the structural support and the first surface is coupled to the access panel.

3. The latch assembly of claim 1, wherein the first surface is substantially parallel to the second surface.

4. The latch assembly of claim 1, wherein the second surface comprises an elongated slot, and the locking system is configured to extend through the elongated slot to couple with the second surface.

5. The latch assembly of claim 1, wherein the locking nut of the locking system is configured to abut a receiving nut secured to the structural support when the latch assembly is in a locked configuration.

6. The latch assembly of claim 5, wherein the locking nut is configured to abut a lip of the receiving nut in the locked configuration, and wherein the lip is disposed between the locking nut and an outer surface of the structural support when the latch assembly is in the locked configuration.

7. The latch assembly of claim 5, comprising the receiving nut, wherein the receiving nut comprises a hex rivet nut.

8. The latch assembly of claim 1, wherein the knob comprises a plastic material.

9. The latch assembly of claim 8, wherein the latch structure comprises a protective coating.

10. The latch assembly of claim 1, wherein the fastener comprises a receptacle and further comprising a rivet, wherein the first surface is configured to couple to the access panel via the rivet extending through the receptacle.

11. A climate management system housing, comprising: an access panel configured to enable access to an interior of the climate management system housing;
   - a gasket coupled to the climate management system housing and configured to provide a sealing engagement with the access panel; and a latch assembly comprising a latch plate having a stepped configuration, a threaded rod coupled to the latch plate, and a locking nut disposed on the threaded rod, wherein the latch assembly is coupled to the access panel and is configured to provide a force on the gasket via the access panel, in a locked configuration of the latch assembly that includes the threaded rod coupling the latch assembly to a structural support of the climate management system housing, to provide the sealing engagement, wherein a position of the locking nut along the threaded rod is adjustable to adjust the force.

12. The climate management system housing of claim 11, wherein the latch plate comprises a first flange coupled to the access panel, an intermediate segment extending from the first flange, and a second flange extending from the intermediate segment, and wherein the first flange is offset from the second flange by the intermediate segment to define the stepped configuration.

13. The climate management system housing of claim 12, comprising a handle coupled to the threaded rod and configured to be rotated to apply the force to the gasket.

14. The climate management system housing of claim 12, wherein the second flange comprises an aperture extending therethrough, wherein the threaded rod is configured to be rotated within the aperture to engage with a receiving nut secured to the climate management system housing and apply the force to the gasket.

15. The climate management system housing of claim 11, comprising a receiving nut coupled to a frame of the climate management system housing, wherein the locking nut is positioned on the threaded rod to enable abutment between the receiving nut and the locking nut when the latch assembly is in a locked configuration.

16. The climate management system housing of claim 15, wherein the locking nut and the receiving nut each comprise a metal, and wherein the climate management system housing comprises a protective coating adjacent to the receiving nut.

17. The climate management system housing of claim 11, wherein the gasket is positioned about a perimeter of an opening of the climate management system housing, wherein the access panel is configured to occlude the opening in a closed position.

18. A locking assembly for a housing, comprising: a latch plate comprising a first flange configured to be coupled to a door of the housing, and comprising a second flange having an aperture extending therethrough; a bolt extending through the aperture in the second flange of the latch plate; a locking nut coupled to the bolt and configured to retain the bolt within the aperture of the second flange of the latch plate; and a receiving nut configured to be disposed within a frame of the housing, wherein the locking nut is configured to abut the receiving nut when the locking assembly is in a locked configuration, and wherein the locking assembly is configured to apply a pressure to a gasket of the housing in the locked configuration to create a sealing interface about the door.

19. The locking assembly of claim 18, wherein the bolt comprises a handle, and wherein the handle is manually rotatable to implement the locked configuration of the locking assembly.

20. The locking assembly of claim 18, wherein the bolt comprises a bolt head, and wherein the bolt head is configured to be rotated by a tool to implement the locked configuration of the locking assembly.

21. The locking assembly of claim 18, wherein the aperture comprises an elongated slot, and wherein the bolt is configured to move within the elongated slot to enable alignment between the bolt and the receiving nut.

22. The locking assembly of claim 18, wherein the latch plate comprises an S-shaped configuration, wherein the S-shaped configuration of the latch plate is defined by the first flange, the second flange, and an intermediate segment extending between the first flange and the second flange and providing an offset distance between the first flange and the second flange.

23. The locking assembly of claim 22, wherein the locking nut is disposed along the bolt between the second flange and a plane defined by the first flange, and wherein a position of the locking nut along the bolt provides a limit to the pressure configured to be applied to the gasket by the locking assembly.

* * * * *